United States Patent [19]

Schaper

[11] 3,955,754

[45] May 11, 1976

[54] CONTINUOUSLY OPERATING CENTRIFUGE HAVING A PLURALITY OF SEPARATING SCREENS

[75] Inventor: Helmut Schaper, Braunschweig, Germany

[73] Assignee: Braunschweigische Maschinenbauanstalt, Braunschweig, Germany

[22] Filed: Oct. 16, 1974

[21] Appl. No.: 515,348

[30] Foreign Application Priority Data

May 24, 1974 Germany ..... 2425105

[52] U.S. Cl. ..... 233/2; 233/27; 233/46; 210/380 R; 127/19

[51] Int. Cl.[2] ..... B04B 7/16

[58] Field of Search ..... 233/2, 1 E, 15, 27, 233/46; 210/380; 127/19

[56] References Cited

UNITED STATES PATENTS

| | | | |
|---|---|---|---|
| 1,946,500 | 2/1934 | Roberts | 210/380 |
| 2,028,168 | 1/1936 | Roberts | 210/380 |
| 3,377,019 | 4/1968 | Cox | 233/2 |
| 3,491,888 | 1/1970 | Colburn et al. | 210/380 |

FOREIGN PATENTS OR APPLICATIONS

| | | | |
|---|---|---|---|
| 1,812,030 | 7/1969 | Germany | 233/2 |
| 1,209,955 | 1/1966 | Germany | 233/2 |

*Primary Examiner*—George H. Krizmanich
*Attorney, Agent, or Firm*—W. G. Fasse; W. W. Roberts

[57] ABSTRACT

A centrifuge has a frusto-conical rotary drum with a continuous surface. A first screen is spaced from the radially inner surface of the drum, and a second screen, coarser than the first screen, is spaced from the radially inner surface of the first screen. A feed container is provided at the narrower lower end of the drum, and means are provided for feeding material to be separated to the feed container, so that the material to be separated is fed from the feed container to the radially inner surface of the inner screen. Means are also provided to separately collect liquids at the upper end of the drum and solids at the upper ends of the screens.

12 Claims, 8 Drawing Figures

Fig. 5
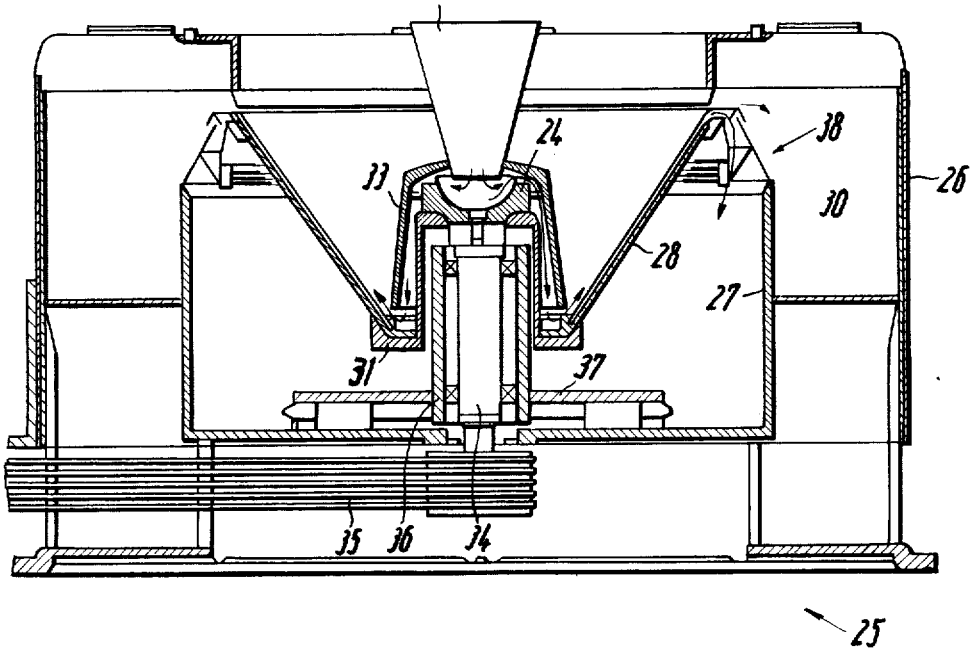
Fig. 6
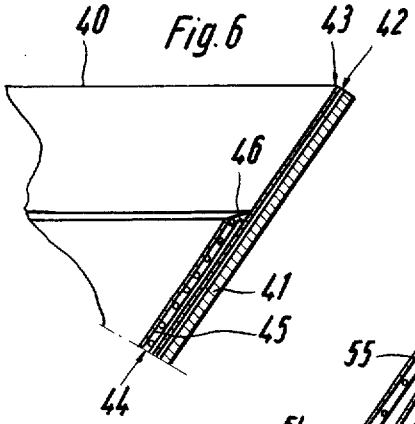
Fig. 8
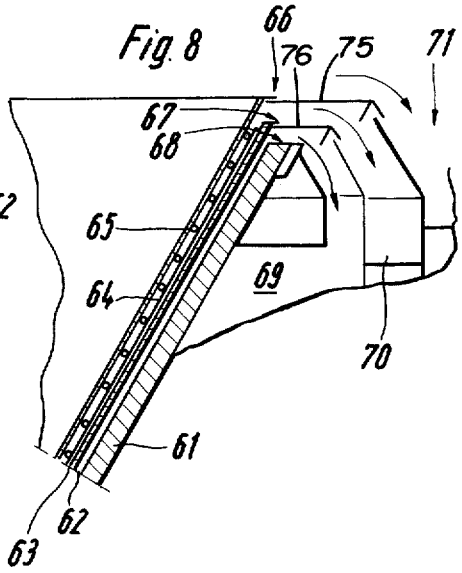
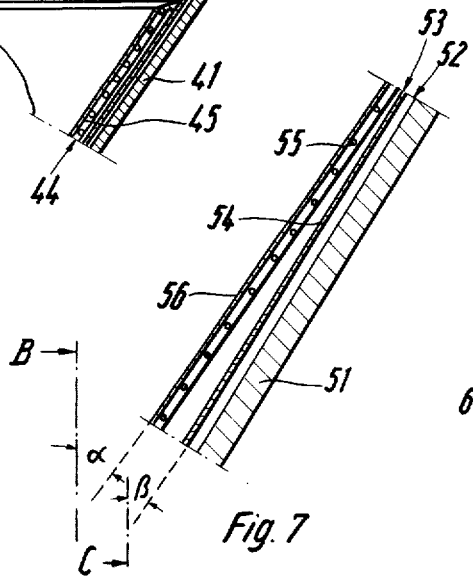
Fig. 7

CONTINUOUSLY OPERATING CENTRIFUGE HAVING A PLURALITY OF SEPARATING SCREENS

BACKGROUND OF THE INVENTION

This invention relates to continuously operating centrifuges for separating solids from fluid mixtures, for example, sugar centrifuges. The invention is particularly directed to a centrifuge of the type having a frusto-conical drum rotatable about a vertical axis and having its larger diameter end facing upwardly.

In centrifuges of this type, a dished feed member is generally provided at the lower end of the frusto-conical drum, and a frusto-conical cover screen supported by a frusto-conical supporting basket is mounted on the inside of the drum. Means are provided for directing a mixture to be separated to the vicinity of the dish shaped feed member, so that the material can pass onto the cover screen. The cover screen is rotatable with the drum, so that the liquids to be separated from the material pass through the cover screen in successive zones until it reaches the upper end of the drum. The solids may be removed after passing upwardly along the inner surface of the cover screen.

The above described continuously operating centrifuges have been employed for a considerable period of time, and their manner of operation and construction are well known. In practical application, and in particular in the case of sugar centrifuges, the particle sizes of the solids which must be separated from the liquid varies over a very large range within the mixture. The cover screen is designed, with respect to the dimensions of the circular or slot-shaped holes therein, so that either the solids of all particle sizes are substantially held back by the cover screen, or so that only the coarser particles are retained by the screen. In the latter case, the fine particles are discharged together with the liquid run-off (e.g., molasses), and a further separation process is necessary to remove the fine particles from the liquid. When the holes in the cover screen are selected to pass the fine solids, the separating performance, and hence the throughput, of the centrifuge is high, even though a substantial portion of the fine particles of the solids is lost. While the holes in the cover screen may be designed to also retain the fine particles, as discussed above, in order to prevent the loss of the fine particles, this expedient has the disadvantage of a considerable reduction in the separating performance of the centrifuge, and hence a reduction in the throughput of the centrifuge.

OBJECTS OF THE INVENTION

It is therefore the object of this invention to overcome the above problems of known centrifuges, and to provide a continuously operating centrifuge of the above type that has a high separating performance, and hence a high throughput, while minimizing the loss of finer particles sizes from the solids.

It is further object of the invention to provide a continuously operating centrifuge of the above type wherein, even though the material to be separated has widely varying particle sizes, the finer particles of the solids may be removed from the mixture together with the coarser particles, while retaining a high separating performance simultaneously with a high throughput.

SUMMARY OF THE INVENTION

Briefly stated, in accordance with the invention, the above objects are achieved by providing a centrifuge of the above type having a second cover screen supported on the first abovementioned cover screen and radially inwardly therefrom. The holes in the upper cover screen are appreciably larger than those in the underlying lower cover screen. In this arrangement, solids greater than a predetermined particle size are retained on the upper cover screen, and pass along the surface of the upper screen, during a centrifuging operation, through the different treatment zones until they reach the upper outer edge of the upper screen surface. Solids of a smaller particle size may pass radially outwardly through the upper cover screen, together with the liquid run-off, such as molasses, whereby the solids of smaller particle size are retained by the lower cover screen. The particles of smaller particle size thus pass, during a centrifuging operation along the surface of the lower cover screen, to the upper edge of the lower cover screen. Thus, a separation of the solids from the liquid run-off takes place in two layers which are mutually spaced apart and independently of one another and pass through the different processing zones on different screen surfaces.

In the operation of the centrifuge in accordance with the invention, the mutually separate layers of solids may behave differently from one another, for example, they may exhibit different slips in the circumferential direction, and they may move at different speeds during a centrifuging operation. Thus, the performance of the centrifuge is substantially increased by virtue of this form of construction. In addition, the separating performance of the centrifuge is improved due to the fact that the two cover screens can be matched to suit the ranges of particle size of the solids which are to be separated. In addition, the service life of the screens may be appreciably increased. The invention provides a further advantage that, since the fine and coarse particles are treated separately, the surfaces upon which these two layers move independently of one another may be provided with different degrees of inclination. For example, the opening angle of the upper cover screen may be either smaller or greater, depending upon the desired characteristics of the centrifuge, than that of the lower cover screen.

In the physical structure of the centrifuge in accordance with the invention, the upper cover screen may be held radially spaced from the lower cover screen by means of a spacer basket. The spacer basket may have a constant thickness, in which case the cover screens extend substantially parallel to one another. Alternatively, the supporting basket may have a thickness which varies in the axial direction of the structure, so that the radial distance between the two cover screens varies, and hence the angle of inclination of the two cover screens is different.

The upper cover screen and its spacer basket are preferably mounted in the centrifuge structure in such a manner that it may be readily exchanged with another upper cover screen, in order to enable the adaptation of the centrifuge to the mixtures to be separated at any given time. The upper cover screen and its support basket are preferably affixed to the drum structure by a suitable clamping arrangement located in the vicinity of the dish shaped feed member or container, in order to facilitate the detachment of the upper cover screen and its support basket.

The upper cover screen may extend throughout the height of the centrifuge drum, but alternatively, the upper cover screen may terminate at a point spaced from the upper edge of the drum, whereby the coarser particles will be combined with the finer particles at the upper portion of the lower cover screen.

In a further embodiment of the invention, the two cover screens may be constructed to enable the two layers of solids to be separately and independently discharged from their cover screens at the upper end of the centrifuge. In this arrangement the upper cover screen may extend beyond the upper edge of the drum, and the upper edge of the lower cover screen, so that separate discharge collection means may be provided for the run-off liquid, the finer particles, and the coarser particles.

In a preferred embodiment of the invention, a spacer basket which is adapted to hold the upper cover screen at a distance radially spaced from the lower cover screen is provided with elements lying on the upper face of the lower cover screen, which do not affect the passage of the layer of particles of small size during a centrifuging operation. In this arrangement, the elements lying against the lower cover screen extend substantially in the direction of a generatrix of the centrifuge drum, these elements preferably support the circumferentially extending elements which in turn support the upper cover screen. Alternatively, however, the elements which lie on the lower cover screen, may be shaped to be curved, with respect to the generatrix of the drum, in a direction opposite to the circumferential direction of movement of the drum, so that these elements do not interfere with slips of the solids on the screen surface occurring during a centrifuging operation.

When the two cover screens have different angles of inclination, the spacer basket therebetween is arranged so that the distance between the screens, determined by the spacer basket, preferably progressively decreases in the direction from the dished feed member or container to the edge of the centrifuge drum.

BRIEF FIGURE DESCRIPTION

In order that the invention may be more clearly understood, it will now be described, by way of example, with reference to the accompanying drawings, wherein:

FIG. 5 is a cross sectional view of a continuously operating centrifuge of the type which may embody the invention, the cetrifuge of FIG. 5 incorporating a drum of the type illustrated in FIG. 1;

FIG. 6 is a cross sectional view of a portion of a drum of the type illustrated in FIG. 1, and showing a modification therein;

FIG. 7 is a cross sectional view of a portion of a drum of the type illustrated in FIG. 1, and illustrating a further embodiment of the invention; and FIG. 8 is a cross sectional view of a portion of a drum of the type illustrated in FIG. 1, and showing a still further embodiment of the invention, in combination with solid and liquid distributing means of the centrifuge.

DETAILED DESCRIPTION OF EXAMPLE EMBODIMENTS

Figure 1:
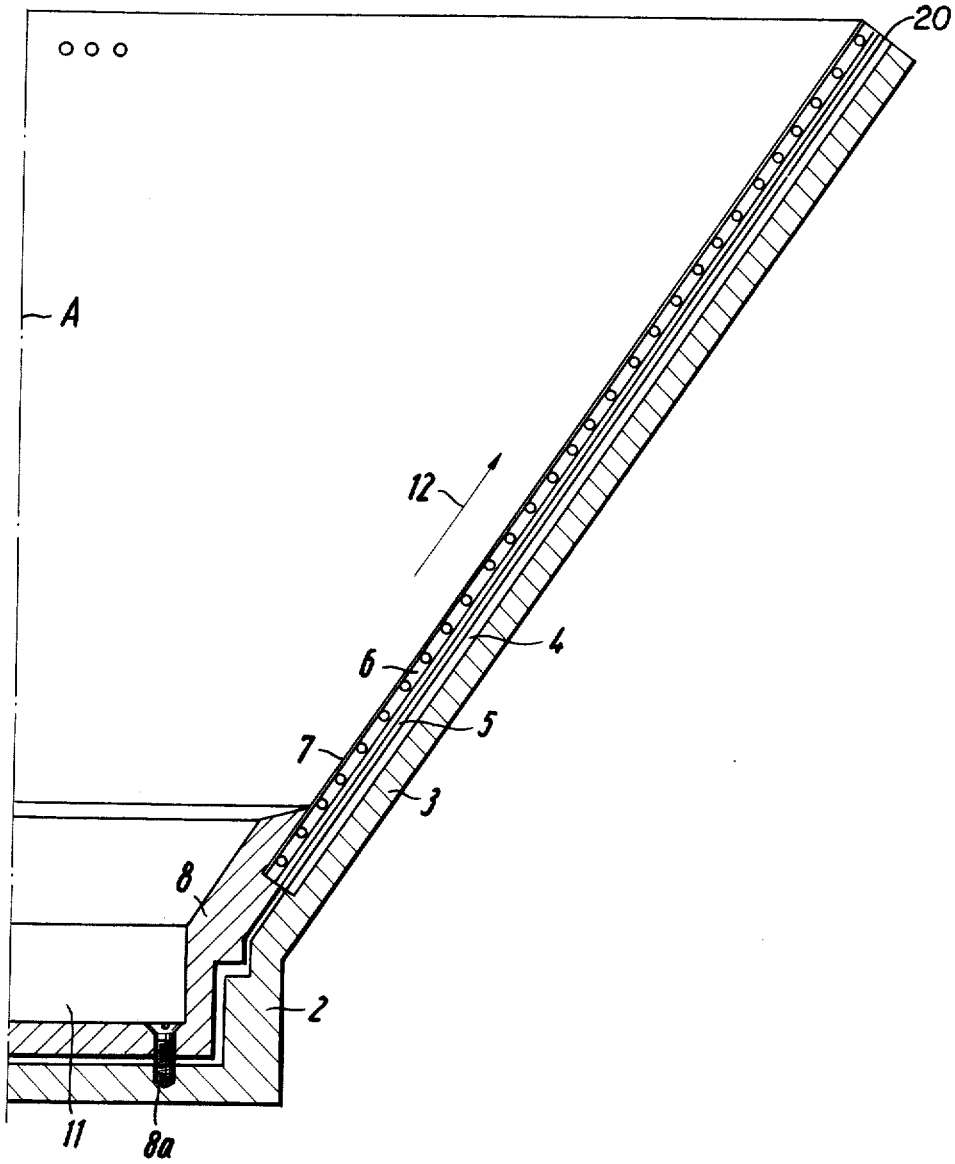
FIG. 1 is a vertical cross sectional view of a portion of the drum of a continuously operating centrifuge in accordance with the invention.

Referring now to the drawings, and more in particular to FIG. 5, therein is illustrated a cross sectional view of a continuously operating centrifuge of the type in which the improvement in accordance with the invention may be employed. As shown in FIG. 5, the centrifuge, denoted generally by the numeral 25, has a fixed outer housing 26 surrounding the centrifuge drum 28. The drum 28 is frusto-conical in shape, and has a vertical axis, with the larger diameter end of the drum being at its upper axial end. The drum 28 is rotated about its axis by a vertical shaft 34, the shaft 34 extending downwardly from the drum and being rotated by means of a belt transmission system 35 including pulleys on the lower end of the shaft 34. A motor system (not shown) is provided outside of the housing for driving the belt transmission system 35. As shown in FIG. 5, the belt transmission system 35 is located in the lower portion of the housing 26.

A fixed intermediate vessel 27 is provided within the housing 26, and defines a collecting chamber 29 generally surrounding the drum 28, for collecting centrifuge liquid. Suitable partitions are provided between the housing 26 and the intermediate vessel 27 to define an annular space 30 for the collection of solid substances which have been discharged from the upper end of the centrifuge drum. A separating device 38 secured, for example, to the upper end of the intermediate vessel 29 separates the solids from the liquids at the upper end of the drum, so that the liquid substances are directed to the collecting chamber 29 and the solid substances are directed to the annular space 30.

A generally dish-shaped feed container 31 is provided at the lower end of the drum 28, and a feed plate 24 axially mounted with respect to the drum 28 and rotatable therewith is axially upwardly spaced from the dish-shaped feed container 31. A feed hopper 32 is provided above the feed plate 24, to direct material to be separated downwardly to the feed plate 24. An inverted frusto-conical acceleration member, mounted for rotation with the drum, extends downwardly from the vicinity of the hopper 32, to direct the material to be separated to the feed container 31.

Thus, material fed into the hopper 32 is directed downwardly to the rotating generally dish-shaped feed member 24. The rotating movement of the container 24 directs the material outwardly, as indicated by the arrows, to flow downwardly on the inside of the conical acceleration member to the feed container 31, and thence upwardly along the inside of the drum 28. A suitable screen, which will be described in greater detail in the following paragraphs, is provided on the inner surface of the drum 28, so that solid material is held on the inside surface of the screen for movement upwardly therealong due to the rotation of the drum, and consequent discharge at the upper end of the drum into the annular space 30. Liquid materials pass through the screen to the inner surface of the drum 28, and are discharged at the upper end of the drum into the collecting chamber 29, the separating device 38 enabling separation of the liquids and solids at the upper end of the drum by directing the solid material on the screen into the space 30 and liquid materials flowing upwardly along the inner surface of the drum 28 into the collecting chamber 29.

The shaft 34 is mounted for rotation in a fixed cylindrical housing 36, the cylindrical housing 36 being affixed to the frame by way of a support member 37, which may also serve as a vaporizing device in the chamber 29.

In the arrangement illustrated in FIG. 5, the shaft 34 is affixed to the feed container 24, which is in turn affixed to an upwardly extending cylindrical portion of the dish-shaped feed container 31. The lower end of the drum 28 is affixed to the feed container 31, so that the rotation of the shaft 34 is transmitted to the drum 28.

Referring now to FIg. 1, which illustrates the portion of the rotating structure of the centrifuge embodying the improvements in accordance with the invention, therein is shown a frusto-conical drum 3, corresponding to the drum 28 of FIG. 5, the drum 3 having a continuous unbroken surface, with a vertical axis and its larger diameter at the upper axial end thereof. The dished feed container 2, corresponding to the dished feed container 31 of FIG. 5, is formed integrally with, and positioned at the lower end of the drum 3. FIG. 1 illustrates generally only one half of the cross sectional view of the drum structure, and it will be understood that the structure of FIG. 1 may be rotated in the same manner as the rotating drum structure of FIG. 5, i.e., by way of a central shaft (not shown in FIG. 1) affixed to a feed plate (not shown in FIG. 1) and thence to the feed container 2, in the manner illustrated in FIG. 5.

A frusto-conical supporting basket 4 is mounted on the inner surface of the drum 3, and a frusto-conical cover screen 5 is supported on the inside of the basket 4. The cover screen 5 is provided with holes extending therethrough, which may be circular or alternatively may be in the form of slots. The above structure, including the supporting basket 4 and cover screen 5 is conventional, this structure having been employed in the past, for example, in sugar centrifuging devices. In such arrangements, the mixture to be separated is introduced or fed into the centrifuge in the vicinity of the dish-shaped container 2 at the lower, narrower end of the conical drum. As a result of forces effective during the centrifuging operation, the mixture passes upwardly along the surface of the cover screen 5, in the upward and outward directions. In this manner, solid substances are separated from the liquids (such as molasses), whereby the solids are discharged from the upper end of the screen 5 and the liquids are discharged from the upper end of the drum 3, after having passed through the screen 5.

In accordance with the invention, a second frusto-conical cover screen 7 is mounted inwardly of the cover screen 5, and is held a distance radially inwardly from the cover screen 5, for example, by means of a spacer basket 6. The holes of the second cover screen 7 may also be circular or in the form of slots. The holes in the upper cover screen 7, however, are selected, relative to the holes of the lower screen 5, so that the upper cover screen 7 only retains or holds back coarser solids at predetermined particle size, while finer solids are only held by the lower cover screen 5. In other words, the holes in the cover screen 7 are preferably larger than the holes in the cover screen 5. Preferably the open portion of the cover screen 6 is appreciably greater than the open portion of the lower cover screen 5.

As discussed above, the upper cover screen 7 is held radially inwardly of the lower cover screen 5 by means of a spacer basket 6 mounted between the two cover screens. The spacer basket 6 may, for example, be directly supported on the upper (inner) face of the lower cover screen 5. It is preferable that the upper cover screen 7 and the spacer basket 6 be removably mounted in the centrifuge structure. For this purpose, a dish-shaped insert 8, in the form of a dished feed container may be provided within the dish shaped container 2, and held therein by suitable means such as screws 8*a*. The upper edges of the dished feed container 8 are affixed to the lower ends of the upper cover screen 7 and the spacer basket 6 by suitable conventional means. For example, the upper ends of the dished shaped member 8 may be frusto-conical, so that, upon downward movement of the member 8, due to screwing of this member in position, its upper ends firmly clamp the lower ends of the upper cover screen 7 and spacer basket 6 in position against the lower ends of the cover screen 5 as illustrated in FIG. 1. The member 8 may also hold the upper cover screen 7 and spacer basket 6 in position by a tensioning effect, since the upper edge of the member 8 has a larger diameter than the lower ends of the cover screen 7 and spacer basket 6.

It will be understood, of course, that in the adaptation of the arrangement of FIG. 1 to the centrifuge of the type illustrated in FIG. 5, the insert 8 may be provided with a central upward extension affixed to the feed container 24 (in FIG. 5), so that the insert 8 (FIG. 1) transmits rotary motion to the dished shaped member 2 and hence to the drum 3.

In the embodiment of the invention illustrated in FIG. 1, which illustrates only a portion of the drum lying to the right of the axis A of rotation of the centrifuge, the mixture is introduced to the hollow portion 11 of the insert 8. Due to the rotation of the structure, the mixture passes from the dished member 8 upwardly in the direction of the arrow 12, onto the upper cover screen 7. The coarser solids are separated from the remainder of the mixture by the upper cover screen 7 so that the coarser solids are retained on the screen 7 and pass upwardly therealong in the direction of the arrow 12. The solids of finer particle size pass together with the run-off (molasses), through the cover screen 7 and thence onto the region between the two cover screens in which the spacer basket 6 is positioned. The liquid run-off also passes through the finer, lower cover screen 5, and flows upwardly in the vicinity of the supporting basket 4, along the inner surface of the drum 3. The solids of finer particle size are retained on the lower cover screen 4, thereby constituting a second layer of solids. These solids also pass upwardly along the upper face of the cover screen 5, in the direction of the arrow 12.

Figure 2:
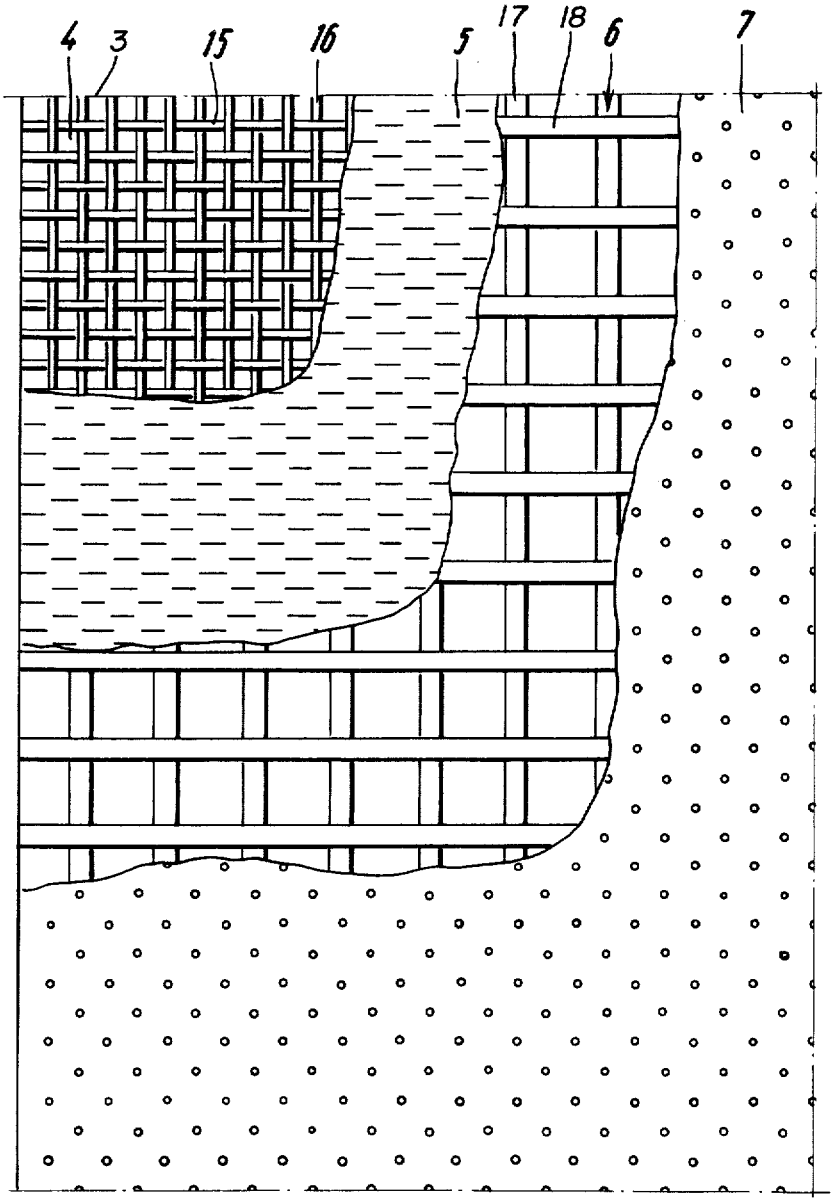
FIG. 2 is a cut-away plan view, on an enlarged scale, of one embodiment of the cover screens and the associated supporting baskets of the drum of FIG. 1.
Figure 3:
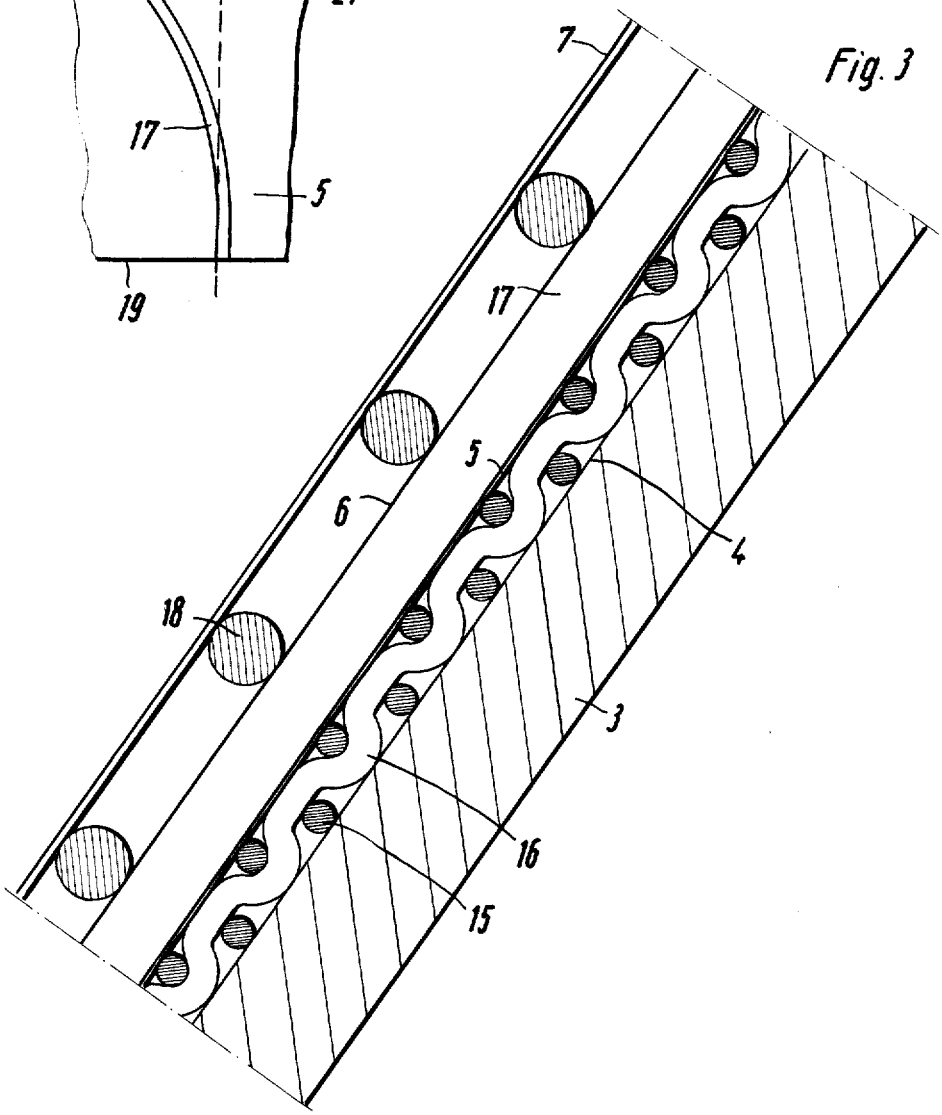
FIG. 3 is a cross sectional view, on an enlarged scale, illustrating in greater detail a portion of the drum cross section of FIG. 1.

The general configuration of the overall screen structure, in accordance with the invention, is illustrated in the cut-away view of FIG. 2, and in the partial cross-sectional view of the screen and drum structure illustrated in FIG. 3. The supporting basket 4, lying against the inner surface of the drum 3, may be comprised of circumferentially extending wires 15 interwoven with wires 16 extending parallel to the generatrix of the drum 3. The lower cover screen 5 is positioned against the screen 4. The inner spacer basket 6 may be comprised of spacer members 17, such as wires 17, extending in the direction of the generatrix of the drum 3, and circumferentially extending spacer members 18, such as wires, extending along the inside of the spacer members 17, whereby fluids may flow upwardly along the surface of the lower cover screen 5 substantially unimpeded by the spacer members 18. The upper cover screen 7 is mounted against the inner surface of the spacer basket 6, in contact with the spacer members 18.

In order not to impede or not appreciably impede the movement of the layer of solids of fine particle size along the surface of the cover screen 5, as discussed above, the spacer basket 6 is formed so that the elements of this basket, which are supported on the upper inner surface of the lower cover screen 5 extend approximately in the direction of the generatrix 21 of the frusto-conical drum. Stated differently, the spacer members 17 normally extend from the lower edge 19 of the lower cover screen in the direction toward the outer or upper edge 20 of this screen, as illustrated in FIG. 1.

Figure 4:
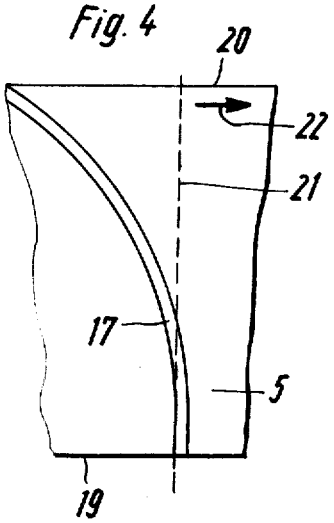
FIG. 4 is a plan view of a portion of the spacer basket of the upper cover screen of a modification of the embodiment of the invention of FIG. 1.

However, due to the rotation of the drum 3, for example, in the direction of arrow 22, there will be a predetermined slipping or sliding movement between the layers of solids and the surface of the cover screen which guides these layers, for example, the cover screen 5. Therefore, referring to FIG. 4, it is preferred that the spacer members 17 of the spacer basket 6 be inclined in a curved manner relative to the generatrix 21 of the frusto-conical drum 3. This curvature extends from the lower edge 19 of the screen 5 tó the upper edge 20 of the screen 5. The curvature is opposite to the direction of movement of the drum. Thus, as illustrated in FIG. 4, the upper end of the member 17 is shown extending to the left, while the direction of movement of the drum surface, indicated by the arrow 22 is toward the right. The curvature is so selected that the members 17 will not adversely affect either the upward movement of solids along the screen 5, nor the movement, caused by the above described slip, of the layers of particles of fine size on the surface of the screen 5. Thus, while the members 17 are depicted in FIG. 2, as being straight, it is preferred that these elements be curved in the manner illustrated in FIG. 4.

The spacer basket 6 is illustrated in FIGS. 2 and 3 as in the form of a grid or grating, in which the circumferentially extending members 18 are arranged above the members 17, the members 17 lying against the lower cover screen 5, and the upper cover screen 7 lying against the spacer members 18.

FIG. 6 illustrates an embodiment of the invention in which the upper cover screen 45 does not extend to the upper end of the drum 41. In this arrangement, a supporting basket 42, corresponding to the support basket 4, in the arrangement of FIG. 1, is mounted on the inner face of the frusto-conical upwardly widening drum 41, and as in the arrangement of FIG. 1, the drum 41 has a continuous unbroken surface. The lower or inner cover screen 43 is supported on the basket 42, which extends with the lower cover screen 43 ot the upper edge 40 of the drum 41. However, the upper cover screen 45 which is supported on the lower cover screen 43 by means of a spacer basket 44, similar to the spacer basket 6 of FIG. 1, and the spacer basket 44 only extends over a portion of the axial height of the drum 41. That is, while these members extend to the bottom of the drum in the manner illustrated in FIG. 1, the upper ends of these members are spaced downwardly from the upper end of the drum 40. The upper end 46 of the upper cover screen 45 extends outwardly over the top of the spacer basket 44, as illustrated in FIG. 6, to abut the surface of the lower cover screen 43. Thus, at the juncture of the upper cover screen 45 and lower cover screen 43, two layers of solids separated in the centrifuge are combined. However, below i.e. inwardly of the upper end of the upper cover layer 45, the two layers of solids on the screens 43 and 45 move completely independently of one another on their associated cover screens. The speeds at which these two layers of solids move on their respective cover screens 43 and 45 may be different. After leaving the upper edge 46 of the upper cover screen 45, however, the layer of solids from the upper cover screen 45 is combined with the finer layer of solids moving upwardly on the cover screen 43, so that both layers of solids will move at the same speed until they reach the upper edge 40 of the drum.

As illustrated in FIG. 1, however, the two cover screens may terminate substantially at the upper edge of the drum 3 which, as discussed above, has a continuous unbroken surface. In all instances, separation of the liquid run-off (e.g molasses) from the solids of coarse particle size and the solids of relatively fine particle size occurs in two stages. When a continuous cover screen is employed, as illustrated in FIG. 1, the two layers of solids are continuously guided separately from each other. The arrangements illustrated in FIGS. 1 and 6 result in a considerable increase in the separating action and in the throughput of the centrifuge. The holes in the two cover screens may be matched to the particle size of the particles to be separated by the openings in the screens may be selected dependent upon the particular conditions prevailing in the operation of the centrifuge. Since the upper cover screen may be formed as a single unit with its associated spacer basket, the single structural unit may be fixed in the drum, for example, in the above described manner, so that it may be easily removed and replaced by another unit adapted to other separating characteristics.

In the above arrangements, described with reference to FIGS. 1 and 6, the two cover screens extend at the same angle with respect to the axis of rotation of the drum. the angle being the same as the angle between the inner surface of the drum and its axis. It may be desirable in some instances, however, to employ separate guidance for the coarser and finer particles for guiding these solids, in the form of layers, on conical guide surfaces having different cone opening angles. For example, as illustrated in FIG. 7, a supporting basket 52 is provided adjacent the continuous inner surface of the drum 51. The supporting basket 52 has a constant thickness, so that the lower cover screen 53, supported on the basket 52 extends substantially parallel to the inner surface of the drum. The spacer basket for the upper cover screen 55 lies on the inner surface of the lower cover screen 53 with its supporting elements 54 extending substantially along the generatrixes of the cover screen 53 and lying under the circumferentially extending elements 55 of this basket. The upper cover screen 56 is thus supported on the inner or upper surface of the elements 55 of the spacer basket. In the arrangement of FIG. 7, the upper spacer basket thus consists of a grid or grating network of circumferential elements 55 and elements 54 which extend substantially along the generatrix of the frusto-conical drum 51. While the elements 55 of the upper spacer basket are of constant cross-section, the thickness of the elements 54 changes as is apparent in FIG. 7. Thus, as illustrated, the thickness of each element 54 decreases in the direction in which the layers of solids pass during a centrifuging operation. It will thus be apparent that the angle $\alpha$ between the generatrix of the upper cover screen 56 and the line B extending parallel to the axis of the rotation of the drum is greater than the angle $\beta$ between the generatrix of the lower screen 53 and the line C, the line C also extending parallel to the axis of rotation of the drum.

While FIG. 7 illustrates the upper screen 56 as having a greater angle with respect to the axis of rotation of the drum than the lower screen 53, it will be apparent that the thickness of the element 54 of the spacer basket may be selected such that the thickness increases in the direction of travel of the layers of solids during a centrifuging operation. In this case, the angle $\beta$ will be greater than the angle $\alpha$. The differences in inclination of the surfaces of the two screens may also be different from those described above, provided that the overall thickness of the spacer basket between the two cover screens alters in the direction of travel of the layers of solids during a centrifuging operation. In addition to having different inclinations, in order to obtain optimum separation of materials fed to the centrifuge, it is apparent that the ratio of open screen surfaces of the two cover screens may also be varied, depending upon the conditions under which the centrifuging operation takes place.

It is to be noted that the above described arrangement in accordance with the invention provides the advantage that the coarser and finer components of the solids may be guided in separate layers over their respective cover screens, so that these two layers of solids may be guided to different and separate discharge points of the centrifuge. As a consequence, the liquid run-off may be separately collected and removed from the centrifuge, and the coarse and fine solids may also be separately collected and discharged on the basis of their particle size.

An arrangement for separating collecting and discharging the coarse and fine solids is illustrated in FIG. 8. Referring now to FIG. 8, the supporting basket 62 for the lower screen 63 is mounted in the drum 61, the drum 61 having a continuous wall surface as in the previously described arrangements. The spacer basket 64 for the upper cover screen 65 is mounted to cover the lower cover screen 63. The upper cover screen 65 extends to the upper edge 66 of the combined rotating unit, so that solids guided upwardly on the screen 65 may be guided away from the centrifuge drum 61 by a fixed guide 75. The guide 75 guides the coarser solids received from the upper cover screen 65 to a collecting space 71, which corresponds to the collecting space 30 illustrated in FIG. 5. The upper spacer basket 64 and the lower cover screen 63 terminate at a point axially spaced below the upper edge 66 of the rotating centrifuge structure at a discharge edge portion 67, so that solids which have been guided on the lower cover screen 63 can pass from this discharge edge portion 67 to be guided by a guiding surface 76 to a separate collection space 70. The liquid run-off, which flows upwardly on the upper or inner face of the drum 61, passes over the upper edge portion 68 of the drum into a collecting space 69 for liquids, such as molasses. The upper edge 68 of the drum 61 is thus spaced below the discharge edge portion 67 of the lower cover screen 63. The liquids and the separate solids may thus be separately removed from their respective collecting spaces by know techniques.

The centrifuge in accordance with the invention enables the separation of particles of fine size from the liquid run-off in a reliable manner, even though the centrifuge has a large throughput. In one example, the open area of the lower screen surface may be approximately 6 to 7 percent of the total screen surface, while the open area of the upper screen surface may have a value greater than 20 percent. The holes of each of the screens may be shaped as slots. For example, the width of the slots of the lower cover screen may be about 0.06 mm and the width of the slots of the upper cover screen 7 may be about 0.35 mm. Although the invention has been described with reference to specific example embodiments, it is to be understood, that it is intended to cover all modifications and equivalents within the scope of the appended claims.

What is claimed is:

1. In a continuously operating centrifuge for separating solids from a fluid mixture, of the type including a frusto-conical drum having a substantially vertical axis with its greater diameter end at the upper end thereof, a screen structure comprising a first frusto-conical cover screen coaxially mounted within said drum for rotation therewith and radially spaced from the inner surface of said drum, said first screen having its larger diameter end at the upper end thereof and a dished feed member mounted at the lower end of said drum for rotation therewith, for directing material to be separated onto said screen structure; the improvement wherein said screen structure further comprises a second cover screen, and means supporting said second cover screen on said first cover screen spaced radially inwardly of said first cover screen, said second cover screen having holes that are substantially larger than the holes of said first cover screen.

2. The centrifuge of claim 1, further comprising a spacer basket between said first and second cover screens for spacing said second cover screen from the surface of said first cover screen.

3. The centrifuge of claim 2, wherein said spacer basket is comprised of spacer elements directly lying against the surface of said first cover screen, said spacer elements extending substantially in the direction of the generatrix of said drum.

4. The centrifuge of claim 3, wherein said spacer basket is further comprised of circumferentially extending elements supported on the radially inner sides of said first mentioned elements, said second cover screen lying against said circumferentially extending elements.

5. The centrifuge of claim 1, further comprising a spacer basket between said first and second cover screens for radially spacing said first and second cover screens, said spacer basket comprising spacing elements lying against the surface of said lower cover screen, said spacer elements extending substantially in the direction of the generatrix of said drum, with a curvature in the circumferential direction corresponding to circumferential slip of solids moving on said first cover screen due to rotation of said drum.

6. The centrifuge of claim 1, wherein said second cover screen extends from said dished feed member only a portion of the distance to the upper end of said drum.

7. The centrifuge of claim 1, wherein said second cover screen is inclined at a different angle to the axis of said drum than said first cover screen.

8. The centrifuge of claim 2, comprising means for removably affixing said second cover screen and spacer basket to said drum at said dished feed member.

9. The centrifuge of claim 2, wherein said dished feed member comprises first means affixed to said drum, and a second dish shaped member removably affixed to the top of said first member, said second member having an upper edge engaging the lower end of said second cover screen for removably clamping said second cover screen and spacer basket with respect to said drum.

10. The centrifuge of claim 1, in which said first and second cover screen extend to the top of said drum, comprising separate discharge means for receiving solids discharged at the upper ends of said first and second screens.

11. The centrifuge of claim 1, wherein the open screen surface of said second cover screen is substantially greater than the open screen surface of said first cover screen.

12. The centrifuge of claim 1, wherein said first and second cover screens extend at substantially the same angle to the axis of said drum.

* * * * *